US011485927B2

(12) United States Patent
Saito et al.

(10) Patent No.: US 11,485,927 B2
(45) Date of Patent: Nov. 1, 2022

(54) LUBRICATING OIL COMPOSITION

(71) Applicant: Cosmo Oil Lubricants Co., Ltd., Tokyo (JP)

(72) Inventors: Takuma Saito, Saitama (JP); Koichi Sakamoto, Saitama (JP); Naoki Asami, Saitama (JP); Atsushi Akamatsu, Tokyo (JP)

(73) Assignee: Cosmo Oil Lubricants Co., Ltd., Tokyo (JP)

( * ) Notice: Subject to any disclaimer, the term of this patent is extended or adjusted under 35 U.S.C. 154(b) by 0 days.

(21) Appl. No.: 17/281,303

(22) PCT Filed: Nov. 28, 2018

(86) PCT No.: PCT/JP2018/043855
§ 371 (c)(1),
(2) Date: Mar. 30, 2021

(87) PCT Pub. No.: WO2020/110243
PCT Pub. Date: Jun. 4, 2020

(65) Prior Publication Data

US 2022/0002629 A1 Jan. 6, 2022

(51) Int. Cl.
*C10M 137/10* (2006.01)
*C10M 137/08* (2006.01)
*C10M 169/04* (2006.01)

(52) U.S. Cl.
CPC ..... *C10M 137/10* (2013.01); *C10M 137/08* (2013.01); *C10M 169/04* (2013.01); *C10M 2209/084* (2013.01); *C10M 2223/043* (2013.01); *C10M 2223/045* (2013.01)

(58) Field of Classification Search
CPC ..... C10M 137/08; C10M 137/10; C10M 169/04; C10M 2209/084; C10M 2223/043; C10M 2223/045
See application file for complete search history.

(56) References Cited

U.S. PATENT DOCUMENTS 3,826,745 A * 7/1974 Ryer et al. ..... C07F 15/04 508/375
8,349,778 B2 * 1/2013 Guinther ..... C10M 141/10 508/430
2008/0125336 A1 * 5/2008 Loper ..... C10M 137/04 508/364

FOREIGN PATENT DOCUMENTS

JP S59-025890 A 2/1984
JP S63-254196 A 10/1988
JP H03-20396 A 1/1991
JP H07-179875 A 7/1995
(Continued)

*Primary Examiner* — James C Goloboy
(74) *Attorney, Agent, or Firm* — Banner & Witcoff, Ltd.

(57) ABSTRACT

A lubricating oil composition includes at least one base oil selected from the group consisting of a mineral oil-based lubricating oil, a synthetic oil-based lubricating oil, and a mixed oil thereof, zinc dialkyldithiophosphate X represented by Formula (1), and an acid phosphate ester amine salt Y represented by Formula (2), in which a content $P_X$ of the X is from 0.06% by mass to 0.08% by mass in terms of phosphorus concentration with respect to a total mass of the lubricating oil composition, and a content $P_Y$ of the Y is from 0.015% by mass to 0.025% by mass in terms of phosphorus concentration with respect to the total mass of the lubricating oil composition.

3 Claims, 1 Drawing Sheet

(56) References Cited

FOREIGN PATENT DOCUMENTS

| | | | |
|---|---|---|---|
| JP | H10-017885 | A | 1/1998 |
| JP | H11-181463 | A | 7/1999 |
| JP | H11-189782 | A | 7/1999 |
| JP | 2002-038180 | A | 2/2002 |
| JP | 2004-059930 | A | 2/2004 |
| JP | 2009-144098 | A | 7/2009 |
| JP | 2010-121063 | A | 6/2010 |
| JP | 2014-019735 | A | 2/2014 |

* cited by examiner

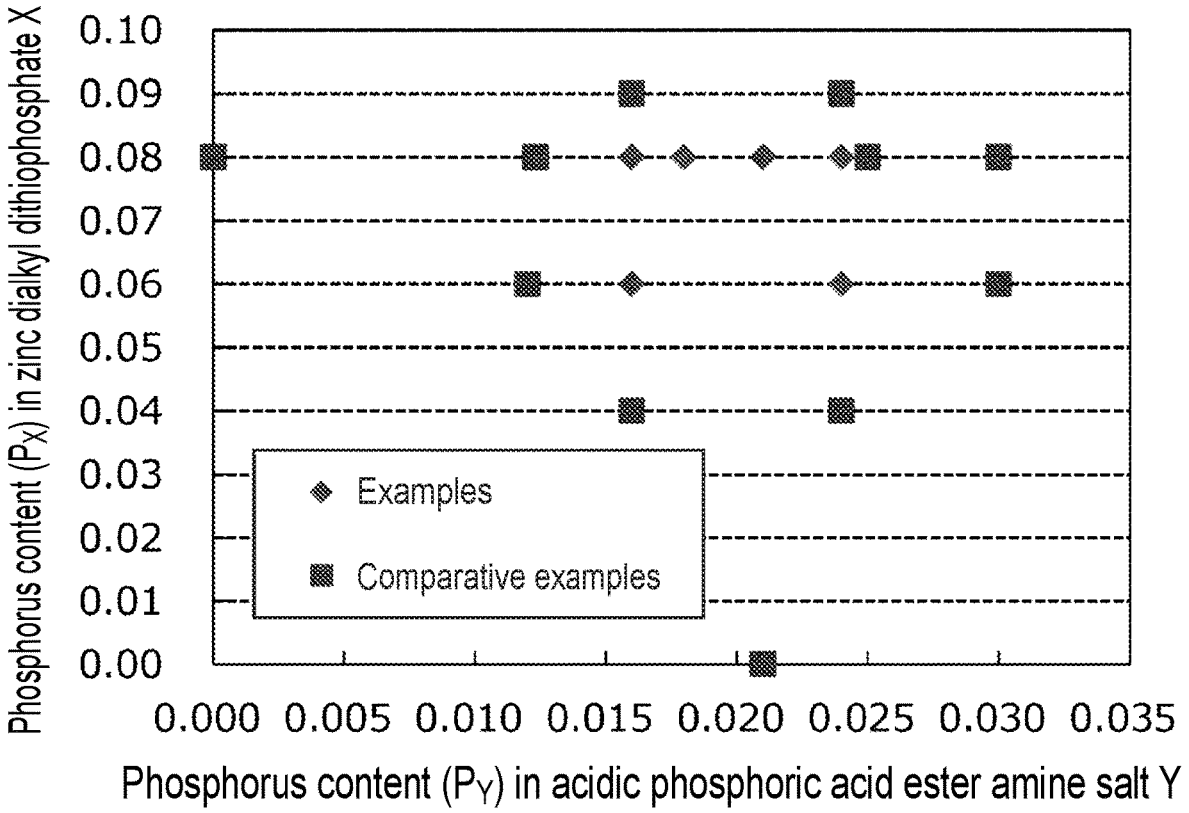
Phosphorus content ($P_X$) in zinc dialkyl dithiophosphate X
0.10
0.09
0.08
0.07
0.06
0.05
0.04
0.03
0.02
0.01
0.00
Examples
Comparative examples
0.000 0.005 0.010 0.015 0.020 0.025 0.030 0.035
Phosphorus content ($P_Y$) in acidic phosphoric acid ester amine salt Y

LUBRICATING OIL COMPOSITION

CROSS-REFERENCE TO RELATED APPLICATIONS

This application is a National Stage Application under 35 U.S.C. 371 of co-pending PCT application number PCT/JP2018/043855 designating the United States and filed Nov. 28, 2018, which is hereby incorporated by reference in its entirety.

TECHNICAL FIELD

This disclosure relates to a lubricating oil composition.

BACKGROUND ART

The agricultural machinery includes a machine for soil preparation such as a tractor, a machine for plant raising control such as a rice-planting machine, a machine for harvesting such as a binder and a combine harvester, etc., and a tractor is most widely used.

Although a tractor has many metal-to-metal contact points in a hydraulic pump unit, a transmission unit, a power take-off (PTO) clutch unit, a differential gear unit, a wet brake unit, etc., in many cases, only one type of lubricating oil for agricultural machinery is used for these contact points.

Therefore, the lubricating oil for agricultural machinery is required to have multifunctional roles, such as frictional performance, abrasion resistance, oxidation stability, an anti-corrosive property, and organic material compatibility. In order to secure these performances, and further enhance them, various additives are currently blended with a selected base oil to form a lubricating oil composition for agricultural machinery, such as the lubricating oil compositions disclosed in Japanese Patent Application Laid-Open (JP-A) No. S59-25890, or JP-A No. H03-20396. Further, as a functional fluid to be used in a method to improve the braking performance and clutch performance of a functional fluid, for example, a functional fluid is disclosed in JP-A No. 2004-59930.

Meanwhile, since the load on gears or the like is increasing along with the power increase in tractors, it is desired that such lubricating oil for agricultural machinery should have an even higher extreme-pressure performance.

Meanwhile, agricultural machinery is sometimes used in an environment where it is liable to come into contact with water, for example, in a paddy field, and contamination of a lubricating oil with water is frequently observed during use. Therefore, it is required that the function of agricultural machinery can be maintained even in a water-infesting environment.

In particular, when an agricultural machine is used in a paddy field, or when a machine is washed, water is prone to enter the oil tank, through which an emulsion is formed in the lubricating oil to cause clogging of the filter. From this point of view, for example, JP-A No. 2009-144098 and JP-A No. 2010-121063 disclose that better inhibition of emulsion formation is intended by optimizing the blending amounts of a metal-based cleaner, and an abrasion preventing agent in the lubricating oil composition.

As mentioned above, it is known that an abrasion preventing agent is blended in a lubricating oil composition for agricultural machinery, and that an acid phosphate amine salt is often blended as the abrasion preventing agent. For example, JP-A No. 2014-19735 discloses a lubricating oil composition for agricultural machinery, in which formation of an emulsion can be inhibited by blending a metal-based cleaner, and a zinc dialkyldithiophosphate with a lubricating oil base oil, and adding a specific amount of an aspartic acid ester derivative expressed by Formula (1).

(1)

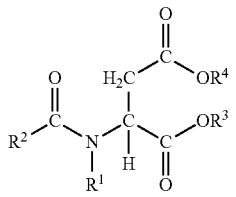

(In Formula (1), each of $R^1$, $R^2$, $R^3$, and $R^4$ represents an alkyl group with a carbon number of 1 to 30, and all of which may be the same alkyl group, or alkyl groups different from each other.

SUMMARY OF INVENTION

Technical Problem

Since the load on gears or the like is increasing in recent years along with the power increase of tractors, it is desired for a lubricating oil composition or a functional fluid described in JP-A No. S59-25890, JP-A No. H03-20396, or JP-A No. 2004-59930 to have even higher extreme pressure property. In particular, when an agricultural machine is used in a paddy field, or when a machine is washed, water is prone to enter the oil tank, through which an emulsion is formed in the lubricating oil to cause clogging of the filter. Consequently, it is desired that the lubricating oil is excellent at inhibiting emulsion formation.

However, when an acid phosphate amine salt is added to a lubricating oil composition in order to prevent wear and inhibit formation of an emulsion, it becomes difficult to obtain a synergistic effect with a zinc dialkyldithiophosphate in the lubricating oil composition. Consequently, further development of lubricating oil compositions is desired because strong inhibition of emulsion while maintaining extreme-pressure performance is hardly attainable in a lubricating oil composition for agricultural machinery described in JP-A No. 2009-144098, JP-A No. 2010-121063, and JP-A No. 2014-19735.

An embodiment of this disclosure was made in view of such circumstances, and provides a lubricating oil composition that inhibits formation of an emulsion after contamination with water while maintaining the extreme pressure property, and exhibits excellent filtration property.

Solution to Problem

As a result of intensive research, the inventors have found that a lubricating oil composition, in which a zinc dialkyldithiophosphate having a specific structure, and an acid phosphate amine salt having a specific structure are added in a specific ratio in terms of phosphorus concentration to a specific base oil, inhibits formation of an emulsion after contamination with water while maintaining the extreme pressure property, and exhibits excellent filtration property.

In other words, this disclosure includes the following modes of implementation.

<1> A lubricating oil composition including:

at least one base oil selected from the group consisting of a mineral oil-based lubricating oil, a synthetic oil-based lubricating oil, and a mixed oil thereof, zinc dialkyldithiophosphate X represented by the following Formula (1), and an acid phosphate ester amine salt Y represented by the following Formula (2), wherein:

a content $P_X$ of the X is from 0.06% by mass to 0.08% by mass in terms of phosphorus concentration with respect to a total mass of the lubricating oil composition, and a content $P_Y$ of the Y is from 0.015% by mass to 0.025% by mass in terms of phosphorus concentration with respect to the total mass of the lubricating oil composition.

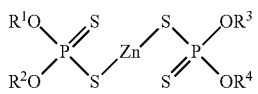

(1)

in Formula (1), each of $R^1$, $R^2$, $R^3$, and $R^4$ independently represents a primary alkyl group having a straight chain or branched chain with a carbon number of 10 to 20.

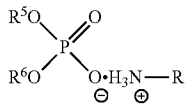

(2)

In Formula (2), each of R, $R^5$, and $R^6$ independently represents a hydrogen atom, or a hydrocarbon group with a carbon number of 3 to 30, and at least one of $R^5$ or $R^6$ represents a hydrocarbon group.

<2>The lubricating oil composition according to <1>, wherein each of $R^1$, $R^2$, $R^3$, and $R^4$ in the above Formula (1) is independently a primary alkyl group having a straight chain with a carbon number of 10 to 12.

<3>The lubricating oil composition according to <1> or <2>, wherein the hydrocarbon group in each of $R^5$ and $R^6$ is at least one hydrocarbon group selected from the group consisting of an alkyl group, an aryl group, an alkenyl group, an alkylaryl group, and an arylalkyl group.

<4>The lubricating oil composition according to any one of <1> to <3>, wherein the lubricating oil composition is an agricultural machinery lubricating oil.

Advantageous Effect of Invention

According to an embodiment of this disclosure, it is possible to provide a lubricating oil composition that inhibits formation of an emulsion after contamination with water while maintaining the extreme pressure property, and exhibits excellent filtration property.

BRIEF DESCRIPTION OF DRAWING

FIG. 1 is a graph showing the relationship between the content $P_X$ of a zinc dialkyldithiophosphate X in terms of phosphorus concentration with respect to the total mass of the composition, and the content $P_Y$ of an acid phosphate ester amine salt Y in terms of phosphorus concentration with respect to the total mass of the composition in Examples and Comparative Examples.

DESCRIPTION OF EMBODIMENTS

An embodiment of this disclosure will be described in detail below.

A numerical range expressed herein by "x to y" includes the values of x and y in the range as the lower limit and upper limit values, respectively. In addition, when only the upper limit of a numerical range expressed by "x to y" wears a unit, it means that the same unit also applies to the lower limit.

In a numerical range described herein in stages, the upper or lower limit of the numerical range of one stage may be replaced with the upper limit value or the lower limit of the numerical range of the other stages. Further, in a numerical range given herein, the upper or lower limit of the numerical range may be replaced with a relevant value shown in Examples.

In referring herein to a content in terms of percentage or amount of a component in a composition, when plural substances exist corresponding to a component in the composition, the content means, unless otherwise specified, the total percentage or amount of the plural substances existing in the composition.

Herein, a combinations of preferable embodiments are more preferable embodiments.

Herein, "extreme pressure property" means the property of preventing seizure of sliding surfaces, when two metal members are slid against each other mediated by a lubricating oil composition.

(Lubricating Oil Composition)

The lubricating oil composition according to this disclosure includes at least one base oil selected from the group consisting of a mineral oil-based lubricating oil, a synthetic oil-based lubricating oil, and a mixed oil thereof, zinc dialkyldithiophosphate X represented by the following Formula (1), and an acid phosphate ester amine salt Y represented by the following Formula (2), wherein the content $P_X$ of the X is from 0.06% by mass to 0.08% by mass in terms of phosphorus concentration with respect to the total mass of the composition, and the content $P_Y$ of the Y is from 0.015% by mass to 0.025% by mass in terms of phosphorus concentration with respect to the total mass of the composition.

The lubricating oil composition of this disclosure includes a specific base oil, a zinc dialkyldithiophosphate X having a specific structure, and an acid phosphate ester amine salt Y having a specific structure, wherein the contents of $P_X$ and $P_Y$ in terms of phosphorus concentration are respectively within specific ranges, and when the contents of $P_X$ and $P_Y$ are at a specific ratio the composition inhibits formation of an emulsion after contamination with water while maintaining extreme pressure property, and is excellent at filtration property.

Although the reason for this is not clear, it is speculated as below. However, the following speculation is not intended to interpret the lubricating oil composition of this disclosure in a limited way, but is presented as an example.

The zinc dialkyldithiophosphate X and acid phosphate ester amine salt Y contained in the lubricating oil composition according to this disclosure impart antiwear performance to the lubricating oil composition by being adsorbed onto the oxidized film surface of a metal, respectively. In other words, there is a limit on the metal surface on which the zinc dialkyldithiophosphate X and acid phosphate amine ester salt Y can be adsorbed, and when either of the zinc dialkyldithiophosphate X and the acid phosphate ester amine salt Y is adsorbed dominantly, the adsorbed amount of the other on the metal surface may be insufficient relative to its addition amount. When the amount of the zinc dialkyldithiophosphate X is dominant, it becomes conceivably difficult to obtain an inhibitory effect on emulsion formation due to shortage of the acid phosphate ester amine salt Y. On the contrary, when the amount of the acid phosphate ester amine salt Y is dominant, it becomes conceivably difficult to attain satisfactory extreme-pressure performance of a lubricating oil composition, due to shortage of the adsorption amount of zinc dialkyldithiophosphate X on the metal surface.

Therefore, when the content of the zinc dialkyldithiophosphate X and the content of the acid phosphate ester amine salt Y are set within predetermined ranges, it becomes conceivably possible to inhibit formation of an emulsion while maintaining extreme-pressure property, and to exhibit excellent filtration property.

Each component of the lubricating oil composition of this disclosure will be described in detail below.

<Base Oil>

The lubricating oil composition according to this disclosure contains at least one kind of base oil selected from the group consisting of a mineral oil-based lubricating oil, a synthetic oil-based lubricating oil, and a mixed oil thereof.

Only one kind of base oil, or a combination of two or more kinds may be contained.

There is no particular restriction on the lubricating oil base oil, and lubricating oils obtained by various manufacturing methods can be used.

As a mineral oil-based lubricating oil, for example, a highly refined paraffinic mineral oil, such as a hydrogenation-refined oil, and a catalytic isomerized oil, which are further treated by solvent dewaxing, or hydrogenation dewaxing, can be preferably used.

Examples of a hydrotreated oil include a raffinate obtained from a base oil source material by solvent refining using an aromatic extraction solvent, such as phenol and furfural, and a hydrotreated oil obtained by a hydrotreatment using a hydrotreating catalyst such as cobalt or molybdenum on a silica-alumina support.

In particular, examples of a suitable base oil include a base oil with a high viscosity index obtained by a hydrocracking process or an isomerization process.

Examples of a synthetic oil-based lubricating oil include a base oil synthesized by a Fischer-Tropsch reaction using methane or other gases as a source material, a poly-α-olefin oligomer, polybutene, an alkylbenzene, a polyol ester, a polyglycol ester, a poly(ethylene-propylene), a hindered ester, and a dibasic acid ester.

This base oil may further contain a phosphate ester, and silicone oil, to the extent that the effect according to this disclosure can be obtained.

The kinematic viscosity of a base oil at 100° C. is preferably from 1.0 $mm^2/s$ to 10.0 $mm^2/s$, more preferably from 2.0 $mm^2/s$ to 8.0 $mm^2/s$, and further preferably from 2.0 $mm^2/s$ to 7.0 $mm^2/s$.

The kinematic viscosity of a base oil can be determined by the same method as that for the kinematic viscosity of a lubricating oil composition described below.

<Zinc Dialkyldithiophosphate X>

The lubricating oil composition according to this disclosure contains a zinc dialkyldithiophosphate X represented by the following Formula (1).

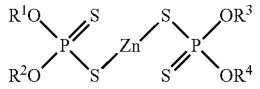

(1)

In Formula (1), each of $R^1$, $R^2$, $R^3$, and $R^4$ independently represents a primary alkyl group having a straight chain or branched chain with a carbon number of 10 to 20.

When the carbon number of the primary alkyl group is from 10 to 20, formation of an emulsion in the lubricating oil composition is inhibited, and the thermal stability tends to be excellent, even after contamination with water of the lubricating oil composition, and even when the lubricating oil composition is exposed to a high temperature environment.

From the viewpoint of stability against hydrolysis, the carbon numbers of the primary alkyl groups represented by $R^1$, $R^2$, $R^3$, and $R^4$ independently are preferably from 10 to 14, more preferably from 10 to 12, and further preferably 12.

From the viewpoint of inhibiting emulsion formation on the occasion of contamination with water, the primary alkyl groups represented by $R^1$, $R^2$, $R^3$, and $R^4$ are all alkyl groups preferably having a straight chain with a carbon number of 10 to 20, more preferably alkyl groups having a straight chain with a carbon number of 10 to 14, further preferably alkyl groups having a straight chain with a carbon number of 10 to 12, and especially preferably alkyl groups having a straight chain with a carbon number of 12.

A primary alkyl group means herein that in a zinc dialkyldithiophosphate X, the carbon atom at the a position adjacent to the oxygen atom bonded to the phosphorus atom is a primary carbon (i.e., —$CH_2$—O—). A secondary alkyl group means that in a zinc dialkyldithiophosphate X, the carbon atom at the a position adjacent to the oxygen atom bonded to the phosphorus atom is a secondary carbon (i.e., >CH—O—).

The content $P_X$ of a zinc dialkyldithiophosphate X is from 0.06% by mass to 0.08% by mass in terms of phosphorus concentration with respect to the total mass of the composition.

When the content $P_X$ of a zinc dialkyldithiophosphate X is from 0.06% by mass to 0.08% by mass in terms of phosphorus concentration with respect to the total mass of the composition, formation of an emulsion after contamination with water can be inhibited while maintaining the extreme pressure property, and also the filtration property can be excellent.

Only one kind of zinc dialkyldithiophosphate X, or a combination of two or more kinds thereof may be contained.

From the above viewpoints, the content $P_X$ of a zinc dialkyldithiophosphate X is preferably from 0.07% by mass to 0.08% by mass with respect to the total mass of the lubricating oil composition.

Meanwhile, in a case where a zinc dialkyldithiophosphate X includes two or more kinds of zinc dialkyldithiophosphate X, the content $P_X$ of the zinc dialkyldithiophosphate X means the total content.

The content $P_X$ of a zinc dialkyldithiophosphate X can be determined, for example, by performing an induction coupled plasma (ICP) spectrochemical analysis, etc., on a lubricating oil composition, and more precisely, it can be calculated by dividing the content $P_X$ (% by mass) of a zinc dialkyldithiophosphate X determined through an ICP spectrochemical analysis by the atomic weight of phosphorus (=30.97).

<Acid Phosphate Ester Amine Salt Y>

The lubricating oil composition according to this disclosure contains an acid phosphate ester amine salt Y represented by the following Formula (2).

(2)

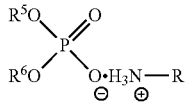

In Formula (2), each of R, $R^5$ and $R^6$ independently represents a hydrogen atom or a hydrocarbon group with a carbon number of 3 to 30, and at least one of $R^5$ or $R^6$ represents a hydrocarbon group.

Examples of a hydrocarbon group with a carbon number of 3 to 30 for $R^5$ and $R^6$ include an aliphatic hydrocarbon group, an alicyclic hydrocarbon group, and an aromatic hydrocarbon group. The aliphatic hydrocarbon group may be either saturated or unsaturated, and may be either straight or branched. The alicyclic hydrocarbon group may be either saturated or unsaturated. The aromatic hydrocarbon group may have a substituent.

The hydrocarbon group with a carbon number of 3 to 30 may be a hydrocarbon group having a halogen atom.

From the viewpoint of inhibiting formation of an emulsion after contamination with water, and excelling in both filtration property and extreme pressure property, the hydrocarbon group with a carbon number of 3 to 30 is preferably at least one selected from the set consisting of an alkyl group, an aryl group, an alkenyl group, an alkylaryl group, and an arylalkyl group, and more preferably an alkyl group.

In Formula (2), examples of the hydrocarbon group with a carbon number of 3 to 30 for R include the aforedescribed hydrocarbon groups with a carbon number of 3 to 30 for $R^5$ and $R^6$.

Among these, the hydrocarbon group with a carbon number of 3 to 30 for R is preferably an aliphatic hydrocarbon group, more preferably an aliphatic hydrocarbon group with a carbon number of 6 to 20, further preferably an aliphatic hydrocarbon group with a carbon number of 12 to 14, and particularly preferably a branched aliphatic hydrocarbon group with a carbon number of 12 to 14.

Examples of the acid phosphate ester amine salt Y represented by Formula (2) include a di-2-ethylhexyl acid phosphate amine salt, a diisodecyl acid phosphate amine salt, a dilauryl acid phosphate amine salt, a dioleyl acid phosphate amine salt, a diphenyl acid phosphate amine salt, a dicresyl acid phosphate amine salt, an S-octylthioethyl acid phosphate amine salt, and an S-dodecylthioethyl acid phosphate amine salt.

Among these, a di-2-ethylhexyl acid phosphate amine salt and a diisodecyl acid phosphate amine salt are preferable.

From the viewpoint of extreme pressure property, the acid phosphate ester amine salt Y represented by Formula (2) is preferably a di-2-ethylhexyl acid phosphate oleylamine salt, or a diisodecyl acid phosphate oleylamine salt.

The content $P_Y$ of the acid phosphate ester amine salt Y is from 0.015% by mass to 0.025% by mass in terms of phosphorus concentration with respect to the total mass of the composition, preferably from 0.016% by mass to 0.024% by mass, and more preferably from 0.018% by mass to 0.022% by mass.

When the content $P_Y$ of the acid phosphate ester amine salt Y is from 0.015% by mass to 0.025% by mass in terms of phosphorus concentration with respect to the total mass of the composition, the antiwear performance and anti-oxidation can be adequately secured, and inhibition of emulsion formation can be excellent.

Only one kind of acid phosphate ester amine salt Y, or a combination of two or more kinds thereof may be contained.

Meanwhile, in a case where an acid phosphate ester amine salt Y includes two or more kinds of acid phosphate ester amine salt Y, the content $P_Y$ of the acid phosphate ester amine salt Y means the total content.

The content $P_Y$ of an acid phosphate ester amine salt Y can be measured by the same method as that for the content $P_X$ of the zinc dialkyldithiophosphate X described above.

In the lubricating oil composition according to this disclosure, it is preferable that the content $P_X$ of X and the content $P_Y$ of Y satisfy the relationship of the following Formula (A).

$$2.5 \leq P_X/P_Y \leq 5.0 \quad \text{Formula (A)}$$

When the content $P_X$ of X, and the content $P_Y$ of Y satisfy the relationship of Formula (A), the extreme pressure property is superior, and inhibition of formation of emulsion after contamination with water, and the filtration property tend to improved further.

From the above view point, the ratio ($P_X/P_Y$) of the content ($P_X$) of X in terms of phosphorus concentration with respect to the total mass of the composition to the content ($P_Y$) of Y in terms of phosphorus concentration with respect to the total mass of the composition is preferably from 3.0 to 6.0, more preferably from 3.2 to 5.5, and further preferably from 2.5 to 5.0.

—Metal-Based Cleaner—

A lubricating oil composition according to this disclosure may further contain a metal-based cleaner. When a lubricating oil composition contains a metal-based cleaner, it becomes possible to ensure a favorable frictional property of a wet clutch.

Examples of a metal-based cleaner include an alkaline-earth metal salt, such as an alkaline earth metal sulfonate, an alkaline earth metal phenate, and an alkaline earth metal salicylate.

Only one kind of metal-based cleaner, or a combination of two or more kinds thereof may be used.

From the viewpoint of achieving both inhibition of emulsion formation and a frictional property required for a wet clutch, an alkaline earth metal sulfonate can be suitably used as the metal-based cleaner.

There is no particular restriction on an alkaline earth metal to be contained in a metal-based cleaner, and calcium, sodium, barium, etc. can be used. Among these, calcium is the most suitable alkaline earth metal. As a metal-based cleaner, an alkaline earth metal salt overbased with carbonic acid or boric acid is preferable.

The base number of a metal-based cleaner is preferably from 150 mg KOH/g to 500 mg KOH/g, more preferably from 200 mg KOH/g to 450 mg KOH/g, and further preferably from 250 mg KOH/g to 450 mg KOH/g in terms of the base number according to the perchloric acid method of JIS K2501 (2003).

The content of a metal-based cleaner is from 0.05% by mass to 0.50% by mass in terms of the amount of an alkaline earth metal based on the total mass of the composition, and preferably from 0.15% by mass to 0.45% by mass.

When the content of metal-based cleaner is in the above range in terms of the amount of an alkaline earth metal based on the total mass of the composition, superior frictional property can be obtained, and inhibition of emulsion formation can be excellent.

—Viscosity Index Improver—

The lubricating oil composition according to this disclosure may contain a viscosity index improver.

There is no particular restriction on the viscosity index improver, and examples thereof include various publicly known viscosity index improvers, such as poly(alkyl (meth) acrylate, an olefin copolymer, polyisobutylene, polyalkylstyrene, a hydrogenated styrene-butadiene copolymer, a hydrogenated styrene-isoprene copolymer, a styrene-maleic anhydride ester copolymer, and compounds thereof additionally having a dispersing group.

Among these, from the viewpoint of superior viscosity property at low temperatures, poly(alkyl (meth)acrylate can be used as a viscosity index improver included in the lubricating oil composition.

The above hydrogenated styrene-butadiene copolymer refers to a copolymer in which a styrene-butadiene copolymer is hydrogenated to modify remaining double bonds to saturated bonds. The above hydrogenated styrene-isoprene copolymer refers to a copolymer in which a styrene-isoprene copolymer is hydrogenated to modify remaining double bonds to saturated bonds.

The weight average molecular weight of poly(alkyl (meth)acrylate) as a viscosity index improver is preferably from 100,000 to 600,000, more preferably from 100,000 to 550,000, and further preferably from 100,000 to 500,000. When the weight average molecular weight of poly(alkyl (meth)acrylate) as a viscosity index improver is within the above range, the low-temperature start-up performance and shear stability are prone to be excellent.

In a case where the lubricating oil composition according to this disclosure contains a viscosity index improver, the content of the viscosity index improver is preferably from 0.5% by mass to 20.0% by mass with respect to the total mass of the composition, and more preferably from 1.0% by mass to 12.0% by mass.

—Other Additives—

Furthermore, the lubricating oil composition according to this disclosure may contain, if necessary, in addition to the above components, publicly known additives, such as a friction modifier other than the zinc dialkyldithiophosphate X and the acid phosphate ester amine salt Y, an abrasion preventing agent, an oily agent, an extreme pressure agent, a rust-preventive agent, an ashless dispersant, an antioxidant, a pour point depressant, an anti-foaming agent, a colorant, an additive package for an agricultural machine hydraulic oil, and an additive package for various lubricating oils containing at least one of these additives, to the extent that the effect according to this disclosure can be obtained.

Examples of a friction modifier include an organomolybdenum compound, a polyhydric alcohol partial ester compound, an amine compound, an amide compound, an ether compound, a sulfurized ester, a phosphoric ester, and a diol compound.

Examples of an abrasion preventing agent include a sulfur compound, a phosphoric ester, and a phosphorous ester.

Examples of an oily agent include oleic acid, stearic acid, a higher alcohol, an amine compound, an amide compound, a sulfurized oil, an acid phosphoric ester, and an acid phosphorous ester.

Examples of an extreme pressure agent include a sulfurized hydrocarbon, a sulfurized oil, a phosphoric ester, a phosphorous ester, a chlorinated paraffin, and a chlorinated diphenyl.

Examples of a rust-preventive agent include a carboxylic acid and its amine salt, an ester compound, a sulfonate, and a boron compound.

Examples of an ashless dispersant include a succinimide having a polyalkenyl group and its boron derivative.

Examples of an antioxidant include an amine compound, a phenol compound, and a sulfur compound.

Examples of a metal deactivator include benzotriazole, thiadiazole, and an alkenylsuccinic ester.

Examples of a pour point depressant include poly(alkyl methacrylate), a chlorinated paraffin-naphthalene condensation product, and an alkylated polystyrene.

Examples of an anti-foaming agent include a silicone compound such as dimethylpolysiloxane, a fluorosilicone compound, and an ester compound.

As a method for preparing a lubricating oil composition according to this disclosure, a base oil, a zinc dialkyldithiophosphate X, and an acid phosphate amine salt Y, as well as various additives as necessary are mixed appropriately. There is no particular restriction on the order of addition of each of these components. They may be added sequentially to the base oil, or various additives may have been added to the base oil in advance.

Although there is no particular restriction on the kinematic viscosity of the lubricating oil composition according to this disclosure, in consideration of stability at a low temperature and a high temperature, and start-up performance, the kinematic viscosity at 100° C. is preferably from 6.0 $mm^2/s$ to 15.0 $mm^2/s$, more preferably from 7.0 $mm^2/s$ to 13.0 $mm^2/s$, further preferably from 7.5 $mm^2/s$ to 11.0 $mm^2/s$, and particularly preferably from 7.5 $mm^2/s$ to 9.0 $mm^2/s$.

When the kinematic viscosity at 100° C. and the viscosity index of a lubricating oil composition meet the above ranges, a lubricating oil composition having favorable lubricating ability and excellent low-temperature start-up performance can be obtained.

The viscosity index of a lubricating oil composition is preferably 150 or more, more preferably 170 or more, and further preferably 190 or more.

When the kinematic viscosity at 100° C. and the viscosity index of a lubricating oil composition meet the above ranges, a lubricating oil composition having favorable lubricating ability and excellent low-temperature start-up performance can be obtained.

The lubricating oil composition according to this disclosure as described above can be used as a lubricating oil for agricultural machinery such as a tractor as an agricultural machine for soil preparation, a rice-planting machine as a machine for plant raising control, and a binder or a combine harvester as a machine for harvesting. The lubricating oil composition can be applied particularly suitably to a tractor, and can be used as a shared lubricating oil for the hydraulic pump unit, the transmission unit, the PTO clutch unit, the differential gear unit, the wet brake unit, etc.

Examples

Next, the disclosure will be described more specifically by way of Examples, but the disclosure is not limited in any way by these Examples.

In each of Examples and Comparative Examples, a base oil and each additive component were used in the amounts set forth in Table 1 or Table 2 to prepare a lubricating oil composition.

The following evaluations were conducted using each of the obtained lubricating oil compositions. The results are shown in Table 1 and Table 2.

The base oil and each additive component used in preparing the lubricating oil compositions in Examples and Comparative Examples are as follows, and the performance of an obtained lubricating oil composition was determined by the following method.

(1) Base Oil

The following base oil 1 or base oil 2 is used such that the kinematic viscosity of the lubricating oil composition at a temperature of 100° C. falls within a range of 8.0 $mm^2/s$ to 8.5 $mm^2/s$.

Base oil 1: Hydrogenation-refined mineral oil with a kinematic viscosity at 100° C. of 3.1 $mm^2/s$, and a viscosity index of 102 (mineral oil-based lubricating oil)

Base oil 2: Hydrogenation-refined mineral oil with a kinematic viscosity at 100° C. of 5.8 $mm^2/s$, and a viscosity index of 109 (mineral oil-based lubricating oil)

(2) Zinc Dialkyldithiophosphate $X_1$

Each of the alkyl groups ($R^1$, $R^2$, $R^3$, and $R^4$) in Formula (1) is a primary alkyl group, and which carbon number is 12. Phosphorus concentration: 6.1% by mass.

(3) Zinc Dialkyldithiophosphate $X_2$

Each of the alkyl groups ($R^1$, $R^2$, $R^3$, and $R^4$) in Formula (1) is a primary alkyl group, and which carbon number is 8. Phosphorus concentration: 7.4% by mass.

(4) Acid Phosphate Ester Amine Salt Y

A branched alkylamine salt with a carbon number of 12 or a carbon number of 14, in which the alkyl groups ($R^5$ and $R^6$) in Formula (2) are those with a carbon number of 8, or a carbon number of 10, or a combination of those with a carbon number of 8 and 10. Phosphorus concentration: 8.2% by mass.

(5) Additive Package

The additive package is a mixture of the following additives.

Metal-based cleaner (overbased calcium sulfonate)

Friction modifier

Silicon-based anti-foaming agent.

The major elemental amounts of the additive package are as follows.

Calcium: 7.3% by mass, sulfur: 1.4% by mass, nitrogen: 0.035% by mass, and silicon: 80 mass ppm.

(6) Viscosity Index Improver

Viscosity index improver A: Poly(alkyl methacrylate) (Weight average molecular weight (Mw): 140,000)

Viscosity index improver B: Poly(alkyl methacrylate) (Weight average molecular weight (Mw): 440,000)

[Evaluation Method]

—Filtration Property—

(1) Water Separability Test

The water mixing method shown in the filterability evaluation of the method described in SAE Paper 972788 was performed. Specifically, 1 mL of water was added to 99 mL of a lubricating oil composition, and the mixture was stirred for 10 min, transferred to a centrifuge tube, and then allowed to stand at 10° C. for 168 hours thereby completing a test sample. The amount (mL) of an emulsion formed after standing was visually measured.

In addition, the centrifuge tube with the sample after standing was shaken up and down for 1 min, and the test sample was filtered using a filter with a pore diameter of 10 μm (manufactured by Millipore) at a reduced pressure of 320 mmHg (42663.04 Pa), and the filtration time (sec) was measured.

In a case where the amount of formed emulsion was less than 2.0 mL, it was judged that inhibition of formation of emulsion after contamination with water was excellent. Further, in a case where the time required for filtrating 50 mL was 300 sec or less, it was judged that clogging of the filter had been inhibited and therefore the filterability (filtration property) was excellent.

In a case where the filtration time for 50 mL exceeded 300 sec, the filter was sometimes so badly clogged that the final filtration time was not measurable, which case was rated as "unfilterable".

—Extreme Pressure Property—

(2) Soda-Type Four-Ball Test

The extreme pressure property (load bearing) was evaluated by measuring the load at a rotation rate of 200 rpm (revolutions per minute) on each lubricating oil composition of Examples and Comparative Examples in accordance with the method described in JIS K 2519 (1995).

In this test, the load was increased by 0.049 MPa every minute, and the load at which stick-slip occurred between the sliding surfaces of the test balls (seizure load) was measured. The obtained seizure load minus 0.049 MPa was used as the acceptable limit load (withstand load), and this operation was repeated three times.

The average value was calculated for the acceptable limit loads for which the difference between the obtained seizure load and the acceptable limit load did not exceed 0.049 MPa. Meanwhile, the value of an acceptable limit load was rounded to the nearest 0.05 MPa according to the provisions of JIS Z 8401 (1999). In a case where the acceptable limit load was 1.00 MPa or higher, it was judged that the extreme pressure property was excellent.

(3) Shell Four-Ball Extreme Pressure Test

The extreme pressure property was evaluated by measuring the weld load (WL) at a rotation rate of 1800 rpm in accordance with the method described in ASTM D2783.

In a case where the weld load was 1570N or more, it was judged that the extreme pressure property was excellent.

In this disclosure, in a case where the extreme pressure property was excellent in each of the Soda-type four-ball test and the Shell four-ball extreme pressure test, it was rated that extreme pressure property was excellent.

In Table 2, "NA" means that the value could not be calculated.

TABLE 1

| | Example 1 | Example 2 | Example 3 | Example 4 | Example 5 | Example 6 | Example 7 |
|---|---|---|---|---|---|---|---|
| Base oil1 | Balance | Balance | Balance | Balance | Balance | Balance | — |
| Base oil2 | — | — | — | — | — | — | Balance |
| Additive package (In terms of Ca) [% by mass] | 0.44 | 0.44 | 0.44 | 0.44 | 0.44 | 0.44 | 0.28 |
| Viscosity index improver A [% by mass] | 8.50 | 8.50 | 8.50 | 8.50 | 8.50 | 8.50 | — |
| Viscosity index improver B [% by mass] | — | — | — | — | — | — | 1.7 |

TABLE 1-continued

| | Example 1 | Example 2 | Example 3 | Example 4 | Example 5 | Example 6 | Example 7 |
|---|---|---|---|---|---|---|---|
| Amount of P of zinc dialkyldithiophosphate $X_1$ ($P_{X1}$) [% by mass] | 0.08 | 0.08 | 0.08 | 0.08 | 0.06 | 0.06 | 0.06 |
| Amount of P of zinc dialkyldithiophosphate $X_2$ ($P_{X2}$) [% by mass] | — | — | — | — | — | — | — |
| Total P amount of zinc dialkyldithiophosphate X ($P_X$) [% by mass] | 0.08 | 0.08 | 0.08 | 0.08 | 0.06 | 0.06 | 0.06 |
| Amount of P of acid phosphate ester amine salt Y ($P_Y$) [% by mass] | 0.016 | 0.018 | 0.021 | 0.024 | 0.016 | 0.024 | 0.016 |
| Total P content ($P_{X+Y}$) | 0.096 | 0.098 | 0.101 | 0.104 | 0.076 | 0.084 | 0.076 |
| $P_X/P_Y$ ratio | 5.0 | 4.4 | 3.8 | 3.3 | 3.8 | 2.5 | 3.8 |
| Evaluation | | | | | | | |
| Emulsion amount (mL) | 1.8 | 1.7 | 1.7 | 1.3 | 1.5 | 1.2 | 1.7 |
| Filtration time (sec) | 202 | 208 | 204 | 213 | 181 | 213 | 240 |
| Soda-type four-ball test Acceptable limit load (MPa) | 1.00 | 1.05 | 1.50 | 1.00 | 1.05 | 1.00 | 1.15 |
| Shell-type four-ball extreme pressure test Weld load (N) | 1570 | 1570 | 1960 | 1570 | 1570 | 1570 | 1570 |

TABLE 2

| | Comparative Example 1 | Comparative Example 2 | Comparative Example 3 | Comparative Example 4 | Comparative Example 5 | Comparative Example 6 |
|---|---|---|---|---|---|---|
| Base oil 1 | Balance | Balance | Balance | Balance | Balance | Balance |
| Additive package (In terms of Ca) [% by mass] | 0.44 | 0.44 | 0.44 | 0.44 | 0.44 | 0.44 |
| Viscosity index improver A [% by mass] | 8.50 | 8.50 | 8.50 | 8.50 | 8.50 | 8.50 |
| Viscosity index improver B [% by mass] | — | — | — | — | — | — |
| Amount of P of zinc dialkyldithiophosphate $X_1$ ($P_{X1}$) [% by mass] | 0.08 | 0.00 | 0.08 | 0.08 | 0.06 | 0.06 |
| Amount of P of zinc dialkyldithiophosphate $X_2$ ($P_{X2}$) [% by mass] | — | — | — | — | — | — |
| Total P amount of zinc dialkyldithiophosphate X ($P_X$) [% by mass] | 0.08 | 0.00 | 0.08 | 0.08 | 0.06 | 0.06 |
| Amount of P of acid phosphate ester amine salt Y ($P_Y$) [% by mass] | 0.000 | 0.021 | 0.012 | 0.030 | 0.012 | 0.030 |
| Total P content ($P_{X+Y}$) | 0.080 | 0.021 | 0.092 | 0.110 | 0.072 | 0.090 |
| $P_X/P_Y$ ratio | NA | NA | 6.5 | 2.7 | 5.0 | 2.0 |
| Evaluation | | | | | | |
| Emulsion amount (mL) | 2.3 | 0.4 | 1.8 | 0.2 | 1.7 | 1.4 |
| Filtration time (sec) | 316 | 196 | 172 | 193 | 214 | 155 |
| Soda-type four-ball test Acceptable limit load (MPa) | 1.60 | 0.50 | 0.90 | 0.95 | 0.90 | 0.75 |
| Shell-type four-ball extreme pressure test Weld load (N) | 1570 | 981 | 1236 | 1236 | 1235 | 1236 |

| | Comparative Example 7 | Comparative Example 8 | Comparative Example 9 | Comparative Example 10 | Comparative Example 11 |
|---|---|---|---|---|---|
| Base oil 1 | Balance | Balance | Balance | Balance | Balance |
| Additive package (In terms of Ca) [% by mass] | 0.44 | 0.44 | 0.44 | 0.44 | 0.44 |
| Viscosity index improver A [% by mass] | 8.50 | 8.50 | 8.50 | 8.50 | 8.50 |
| Viscosity index improver B [% by mass] | — | — | — | — | — |

TABLE 2-continued

| | | | | | |
|---|---|---|---|---|---|
| Amount of P of zinc dialkyldithiophosphate $X_1$ ($P_{X1}$) [% by mass] | 0.04 | 0.09 | 0.04 | 0.09 | 0.04 |
| Amount of P of zinc dialkyldithiophosphate $X_2$ ($P_{X2}$) [% by mass] | — | — | — | — | 0.04 |
| Total P amount of zinc dialkyldithiophosphate X ($P_X$) [% by mass] | 0.04 | 0.09 | 0.04 | 0.09 | 0.08 |
| Amount of P of acid phosphate ester amine salt Y ($P_Y$) [% by mass] | 0.016 | 0.024 | 0.024 | 0.016 | 0.025 |
| Total P content ($P_{X+Y}$) | 0.056 | 0.114 | 0.064 | 0.106 | 0.105 |
| $P_X/P_Y$ ratio | 2.5 | 3.8 | 1.7 | 5.6 | 3.2 |
| Evaluation | | | | | |
| Emulsion amount (mL) | 0.4 | 2.9 | 0.2 | 2.3 | 1.7 |
| Filtration time (sec) | 203 | Unfilterable | 170 | 253 | 199 |
| Soda-type four-ball test Acceptable limit load (MPa) | 0.95 | 0.60 | 0.90 | 1.15 | 0.90 |
| Shell-type four-ball extreme pressure test Weld load (N) | 1236 | 1236 | 1236 | 1570 | 1236 |

As obvious from Table 1, Table 2, and FIG. 1, the lubricating oil compositions of Examples containing a zinc dialkyldithiophosphate X, and an acid phosphate ester amine salt Y in the predetermined ratio can better inhibit formation of an emulsion after contamination with water while maintaining the extreme pressure property, and can be superior in filtration property compared to the lubricating oil compositions of Comparative Examples. In particular, with the lubricating oil compositions of Examples, the amounts of the formed emulsion were smaller than those in Comparative Examples 1, 8 and 10, the time required for filtration was shorter, and the extreme pressure property was superior.

As shown in Table 2, in Comparative Examples 6 and 9, where $P_X/P_Y$ was less than 2.5, and in Comparative Example 3 and Comparative Example 10, where $P_X/P_Y$ was more than 5.0, the extreme pressure property was inferior compared to the lubricating oil compositions in Examples.

Meanwhile, in Comparative Example 8, in which $P_X/P_Y$ in the lubricating oil composition was within the predetermined range, however the content of a zinc dialkyldithiophosphate X was 0.08% by mass or higher in terms of phosphorus concentration with respect to the total mass of the composition, the amount of the formed emulsion was larger, the filtration property was inferior, and the extreme pressure property was also inferior compared to those of the lubricating oil compositions of Examples.

In the lubricating oil composition of Comparative Example 11, since the carbon number of the alkyl groups represented by $R^1$, $R^2$, $R^3$, and $R^4$ in the above Formula (1) for the zinc dialkyldithiophosphate $X_2$ was 8, the extreme pressure property was inferior compared to that of the lubricating oil compositions of Examples.

As described above, the lubricating oil composition according to this disclosure inhibits formation of an emulsion after contamination with water while maintaining the extreme pressure property, and has an excellent filtration property. Therefore, it can be suitably used as a lubricating oil composition for agricultural machinery.

The invention claimed is:

1. A lubricating oil composition comprising:

a hydrogenation-refined mineral oil having a kinematic viscosity at 100° C. from 2.0 $mm^2/s$ to 7.0 $mm^2/s$, zinc dialkyldithiophosphate X represented by the following Formula (1), and an acid phosphate ester amine salt Y represented by the following Formula (2), wherein:

a content $P_x$ of the X is from 0.06% by mass to 0.08% by mass in terms of phosphorus concentration with respect to a total mass of the lubricating oil composition, and a content $P_y$ of the Y is from 0.015% by mass to 0.025% by mass in terms of phosphorus concentration with respect to the total mass of the lubricating oil composition:

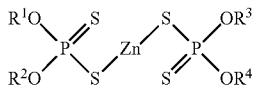

(1)

in Formula (1), each of $R^1$, $R^2$, $R^3$, and $R^4$ independently represents a primary alkyl group having a straight chain or branched chain with a carbon number of 12;

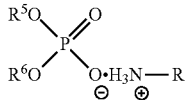

(2)

in Formula (2), R represents a branched alkyl group with a carbon number of 12 or 14, and each of $R^5$ and $R^6$ independently represents an alkyl group with a carbon number of 8 or 10, wherein the lubricating oil composition is characterized by (1) an emulsion amount of 1.8 mL or less as determined by the mixing method described in SAE Paper 972788 using 1 mL of water added to 99 mL of the lubricating oil composition, mixing for 10 minutes and allowing to stand at 10° C. for 168 hours, (2) a filtration time of 240 seconds or less as determined by filtering the emulsion of (1) after shaking up and down for 1 minute and using a filter with a pore diameter of 10 μm at a pressure of 320 mmHg, (3) a load limit of 1 MPa or greater as determined by a soda-type four-ball test described in JIS K 2519 (1995) at a rotation rate of 200 rpm, where the load is increased by 0.049 MPa per minute and seizure load at which stick-slip occurred between sliding surfaces of the test balls is measured and withstand load is determined as the obtained seizure load minus 0.049 MPa, obtaining three withstand loads, and calculating the average value for the withstand loads for which the difference between the obtained seizure load and the withstand load did not exceed 0.049 MPa, and (4) a weld load of 1570 N or greater as determined at a rotation rate of 1800 rpm according to the method described in ASTM D2783.

2. The lubricating oil composition according to claim 1, wherein each of $R^1$, $R^2$, $R^3$, and $R^4$ in the above Formula (1) is independently a primary alkyl group having a straight chain.

3. The lubricating oil composition according to claim 1, wherein the content $P_x$ of the X and the content $P_y$ of the Y satisfy the relationship of the following Formula (A):

$$2.5 \leq P_x P_y \leq 5.0 \quad \text{(A)}$$

* * * * *